US010230162B2

(12) United States Patent
Wang et al.

(10) Patent No.: US 10,230,162 B2
(45) Date of Patent: Mar. 12, 2019

(54) ANTENNA SYSTEM

(71) Applicants: Chao Wang, Shenzhen (CN); Yongli Chen, Shenzhen (CN); Ya Wang, Shenzhen (CN)

(72) Inventors: Chao Wang, Shenzhen (CN); Yongli Chen, Shenzhen (CN); Ya Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 193 days.

(21) Appl. No.: 15/417,199

(22) Filed: Jan. 26, 2017

(65) Prior Publication Data

US 2018/0123234 A1 May 3, 2018

(30) Foreign Application Priority Data

Oct. 27, 2016 (CN) ..... 2016 1 0974435

(51) Int. Cl.

| | |
|---|---|
| ***H01Q 1/48*** | (2006.01) |
| ***H01Q 1/22*** | (2006.01) |
| ***H01Q 1/24*** | (2006.01) |
| ***H01Q 9/42*** | (2006.01) |

(52) U.S. Cl.

CPC ..... *H01Q 1/48* (2013.01); *H01Q 1/2291* (2013.01); *H01Q 1/243* (2013.01); *H01Q 9/42* (2013.01)

(58) Field of Classification Search

CPC ..... H01Q 1/243; H01Q 1/48; H01Q 1/36; H01Q 1/2291; H01Q 7/00

USPC ..... 343/702

See application file for complete search history.

(56) References Cited

U.S. PATENT DOCUMENTS

| | | | | |
|---|---|---|---|---|
| 2015/0207211 | A1* | 7/2015 | Martiskainen | H01Q 21/30 343/702 |
| 2015/0372372 | A1* | 12/2015 | Lee | H01Q 1/243 343/702 |
| 2017/0117614 | A1* | 4/2017 | Wu | H01Q 1/243 |

* cited by examiner

*Primary Examiner* — Hai Tran

(74) *Attorney, Agent, or Firm* — Na Xu; IPro, PLLC

(57) ABSTRACT

Provided is an antenna system, including a system ground unit, a metal back cover, a frame as antenna radiator, and a grounding circuit, a feeding circuit and a tuning switch, the antenna radiator includes a main radiator and an auxiliary radiator; the main radiator includes a first main radiator which forms, together with the metal back cover, a first main gap, a second main radiator extending from the first main radiator and forms, together with the metal back cover, a second main gap, and a first fracture separating the first main radiator into two parts; the auxiliary radiator includes a first auxiliary radiator which forms, together with the metal back cover, a first auxiliary gap, a second auxiliary radiator extending from the first auxiliary radiator and forms, together with the metal back cover, a second auxiliary gap, and a second fracture separating the first auxiliary radiator into two parts.

10 Claims, 11 Drawing Sheets

ANTENNA SYSTEM

TECHNICAL FIELD

The present disclosure relates to an antenna and, in particular, to an antenna system applied in the field of communication electronic product.

BACKGROUND

With the development of mobile communication technologies, electronic products such as cellphone, PAD, laptop etc. have become a necessity in people's life, and such electronic products are updated to incorporate an antenna system so that they become electronic communication products having communication functions. However, the consumers are not merely satisfied with the application functions, the requirements on appearance of the electronic communication product is also increasing. The electronic communication product with a metal housing has a good texture, and is firm and durable, and therefore becomes more and more popular to consumers.

Since the electromagnetic wave cannot penetrate metal, which is adverse to radiation of the antenna system. Therefore, when designing the electronic communication product with metal housing, generally the antenna system is externally arranged, or in a manner such that the antenna system will not be surrounded by metal. For example, a gap is provided on the metal back cover of the electronic communication product with metal housing, which facilitates radiation of the antenna system. However, the antenna system with such design has narrow frequency band and low efficiency. In addition, the gap design affects the appearance of the electronic communication product with metal housing. In order to reduce the shielding effect of the metal housing to the antenna system, generally a gap larger than 5 mm is provided in the electronic communication product, which may affect the stacking and arrangement of the electronic components in the electronic communication product. Moreover, the antenna system in the related art is a single antenna structure, the radiation frequency band range is limited, which restricts the performance of the antenna system.

Therefore, there is a necessity to provide a new antenna system so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
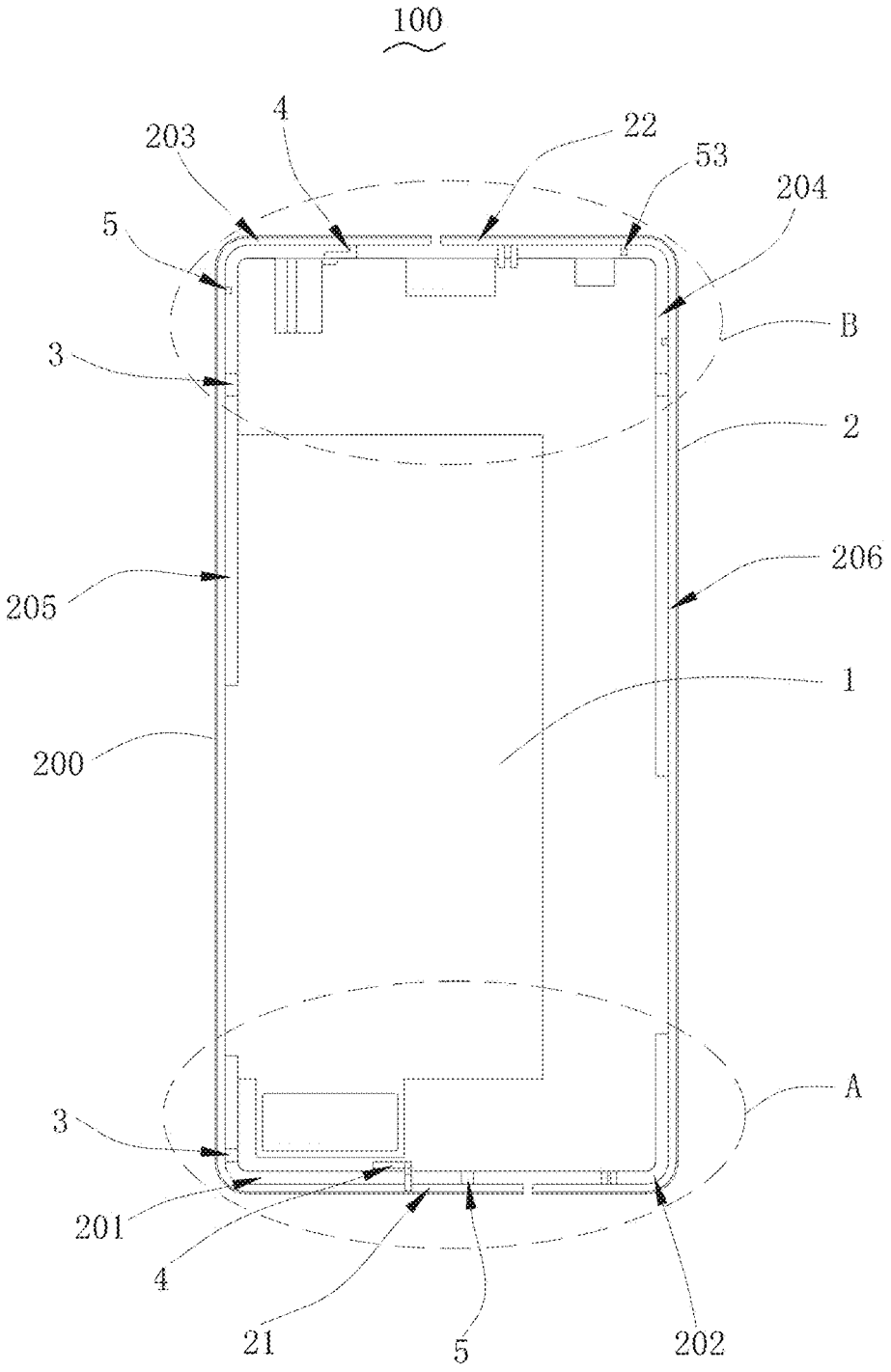
FIG. 1 is a perspective structural view of an antenna system in accordance with the present disclosure.

Please refer to FIG. 1, which is a perspective structural view of an antenna system in accordance with the present disclosure. An antenna system 100 provided by the present disclosure, including a system ground unit (not shown), a metal back cover 1 electrically connected with the system ground unit, a frame 200 which is provided surrounding a periphery of the metal back cover 1 and serves as an antenna radiator 2, and a grounding circuit 3, a feeding circuit 4 and a tuning switch 5 respectively connected with the antenna radiator 2 and the system ground unit.

The system ground unit includes a grounding point (not shown) and a feeding point (not shown), configured to achieve signal communication of the antenna radiator 2.

The antenna radiator 2 includes a main radiator 21 and an auxiliary radiator 22 provided at two opposite sides of the metal back cover 1. The main radiator 21 and the auxiliary radiator 22 are configured to form an antenna, respectively. In the present embodiment, the antenna radiator 2 is made of metal material, so that a resonance circuit can be constituted in between with the system ground unit, so as to form effective radiation space.

The main radiator includes a first main radiator 211 which forms, together with the metal back cover 1, a first main gap 6, a second main radiator 212 which extends from the first main radiator 211 and forms, together with the metal back cover 1, a second main gap 7, and a first fracture 213 which separates the first main radiator 211 into two parts.

The auxiliary radiator 22 includes a first auxiliary radiator 221 which forms, together with the metal back cover 1, a first auxiliary gap 8, a second auxiliary radiator 222 which extends from the first auxiliary radiator 221 and forms, together with the metal back cover 1, a second auxiliary gap 9, and a second fracture 223 which separates the first auxiliary radiator 221 into two parts.

The first main gap 6, the second main gap 7, the first auxiliary gap 8, the second auxiliary gap 9, the first fracture 213 and the second fracture 223 are used to form a coupling gap, so as to achieve signal radiation.

Both the shape and size of the fracture and coupling gap affect the frequency band range of the antenna system 100, in the present embodiment, widths of the first fracture 213 and the second fracture 223 are within 1 mm-1.5 mm, optionally 1.5 mm The widths of the first main gap 6, the second main gap 7, the first auxiliary gap 8, and the second auxiliary gap 9 are within 1.5 mm-2 mm, optionally 2 mm.

In addition, the first main gap 6 make the metal back cover 1 be spaced from the frame 200 for a certain distance so as to form a first headroom region; the second main gap 7 make the metal back cover 1 be spaced from the frame 200 for a certain distance so as to form a second headroom region; the first auxiliary gap 8 make the metal back cover 1 be spaced from the frame 200 for a certain distance so as to form a third headroom region; the second auxiliary gap 9 make the metal back cover 1 be spaced from the frame 200 for a certain distance so as to form a fourth headroom region. In the present embodiment, the widths of the first headroom region, the second headroom region, the third headroom region and the fourth headroom region are optionally within 1.5 mm-2 mm, which is far smaller than the width of the headroom region in the prior art (larger than 5 mm).

Figure 2:
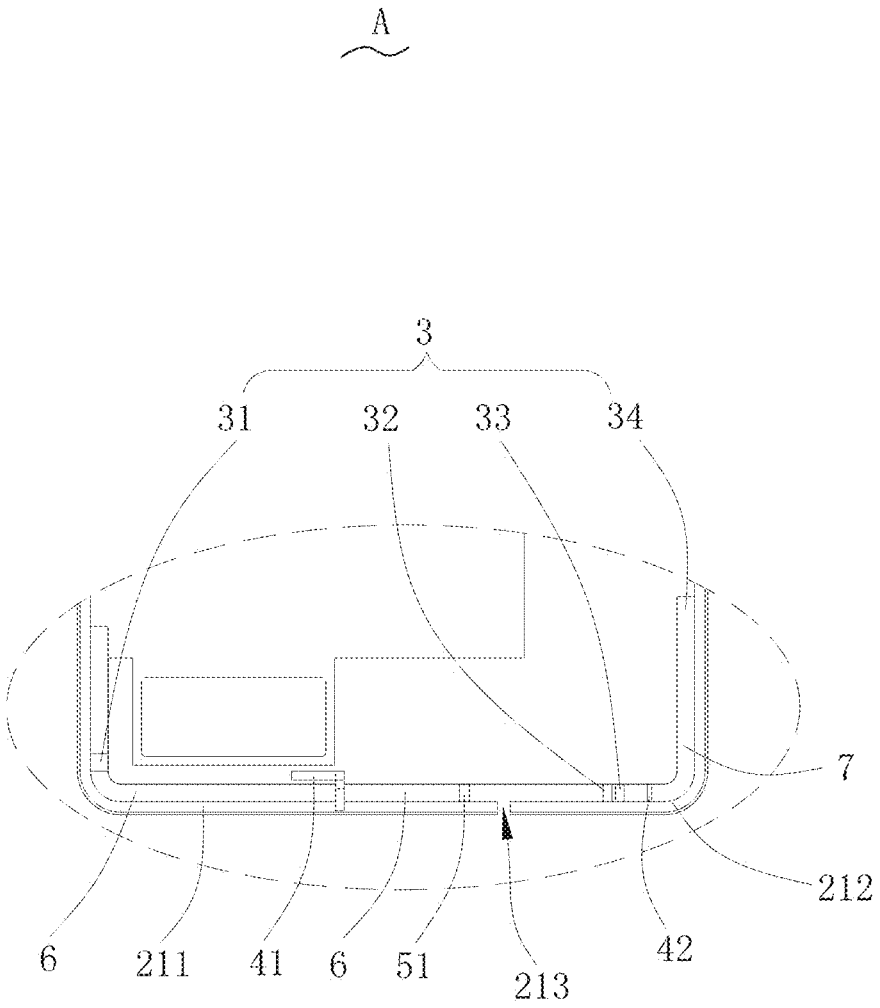
FIG. 2 is a structural enlarged view of portion A in FIG. 1.
Figure 3:
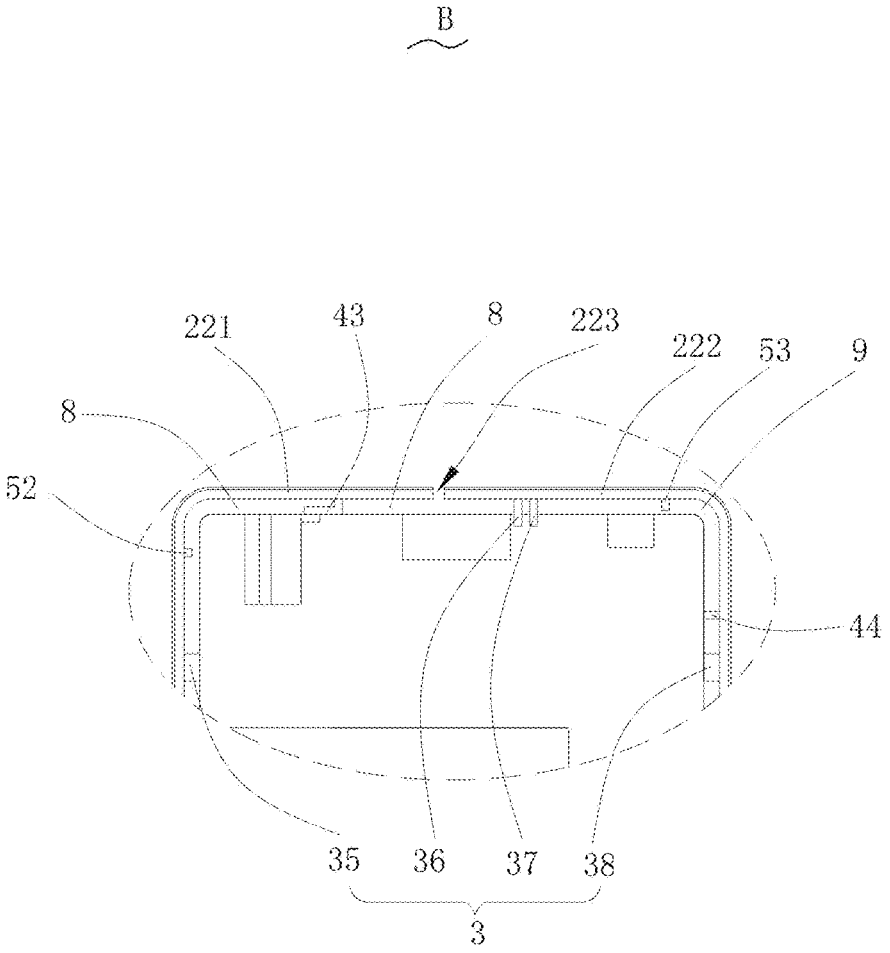
FIG. 3 is a structural enlarged view of portion B in FIG. 1.

Please refer to FIG. 2 and FIG. 3, FIG. 2 is a structural enlarged view of portion A in FIG. 1; FIG. 3 is a structural enlarged view of portion B in FIG. 1.

The grounding circuit 3, the feeding circuit 4 are important parts of the antenna system, which directly affect the radiation frequency of the antenna system. The grounding circuit 3 and the feeding circuit 4 form the signal transmission path of the antenna system 100. The grounding circuit 3 is connected with ground, the feeding circuit 4 is electrically connected with the feeding point. In the present embodiment, the system ground unit includes the grounding point (not shown) and the feeding point (not shown), the grounding circuit 3 and the feeding circuit 4 are configured to achieve electrical connection between the antenna radiator 2 and the system ground unit, so as to control resonance frequency of the antenna system 100.

The grounding circuit 3 includes a first grounding circuit 31, a second grounding circuit 32, a third grounding circuit 33, a fourth grounding circuit 34, a fifth grounding circuit 35, a sixth grounding circuit 36, a seventh grounding circuit 37 and an eighth grounding circuit 38.

Specifically, the first grounding circuit 31 and the second grounding circuit 32 are respectively provided at two ends of the first main radiator 211, and are electrically connected with the system ground unit. The third grounding circuit 33 and the fourth grounding circuit 34 are respectively provided at two ends of the second main radiator 212, and are electrically connected with the system ground unit. The fifth grounding circuit 35 and the sixth grounding circuit 36 are respectively provided at two ends of the first auxiliary radiator 221, and are electrically connected with the system ground unit. The seventh grounding circuit 37 and the eighth grounding circuit 38 are respectively provided at two ends of the second auxiliary radiator 222, and are electrically connected with the system ground unit. The second grounding circuit 32 is adjoined with the third grounding circuit 33, the sixth grounding circuit 36 is adjoined with the seventh grounding circuit 37.

The feeding circuit 4 includes a first feeding circuit 41, a second feeding circuit 42, a third feeding circuit 43 and a fourth feeding circuit 44.

The first feeding circuit 41 is connected between the first main radiator 211 and the system ground unit, and is located between the first fracture 213 and the first grounding circuit 31. The second feeding circuit 42 is connected between the second main radiator 212 and the system ground unit, and is located between the third grounding circuit 33 and the fourth grounding circuit 34. The third feeding circuit 43 is connected between the first auxiliary radiator 221 and the system ground unit, and is located between the second fracture 223 and the fifth grounding circuit 35. The fourth feeding circuit 44 is connected between the second auxiliary radiator 222 and the system ground unit, and is located between the seventh grounding circuit 37 and the eighth grounding circuit 38.

The tuning switch 5 includes a first switch 51, a second switch 52 and a third switch 53.

The first switch 51 is connected between the first main radiator 211 and the system ground unit, and is located between the first feeding circuit 41 and the first fracture 213. The second switch 52 is connected between the first auxiliary radiator 221 and the system ground unit, and is located between the fifth grounding circuit 35 and the third feeding circuit 43. The third switch 53 is connected between the second auxiliary radiator 222 and the system ground unit, and is located between the seventh grounding circuit 37 and the fourth feeding circuit 44.

In the present embodiment, the tuning switch 5 is optionally an active switch, and the tuning switch 5 can be one or more selected from adjustable capacitance switch, inductance switch, resistance switch and radio frequency switch. The adjustable capacitance switch, inductance switch, resistance switch and radio frequency switch are used in the frequency band of the antenna system 100, which cooperate with each other for tuning, so that the antenna system 100 of the present disclosure can cover full frequency bands.

The first main radiator 211, the second main radiator 212, the first auxiliary radiator 213, and the second auxiliary radiator 222 of the antenna system 100 of the present disclosure form the first antenna 201, the second antenna 202, the first auxiliary antenna 203 and the second auxiliary antenna 204, respectively. The four antennas are only provided with two fractures, so that the antenna system 100 has better appearance. Optionally, the first fracture 213 and the second fracture 223 are filled with non-metal material. Such a structural configuration makes the antenna radiator 2 be an integral structure, which further improves the appearance of the antenna system 100.

Figure 4:
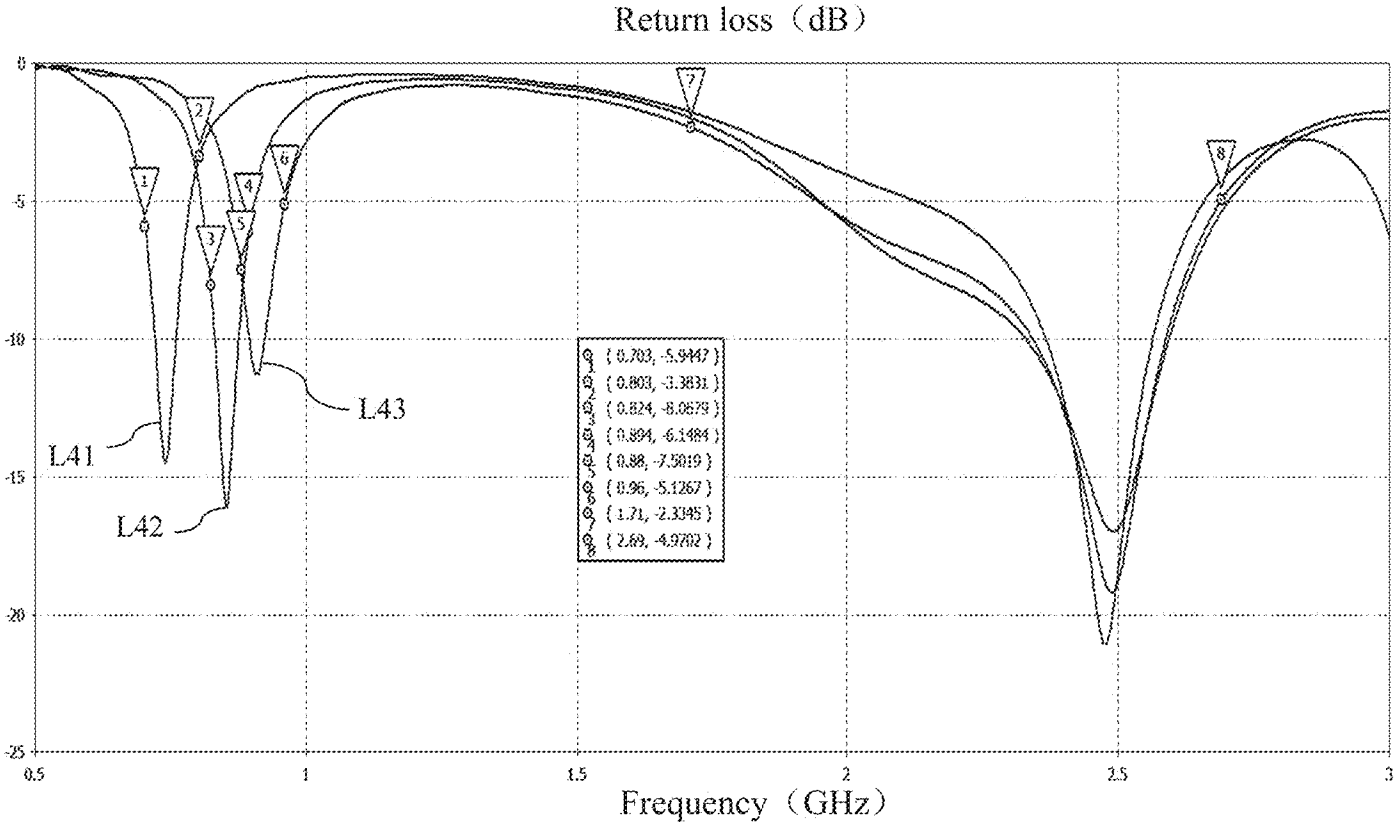
FIG. 4 is a view showing return loss of a first main antenna in FIG. 2.
Figure 5:
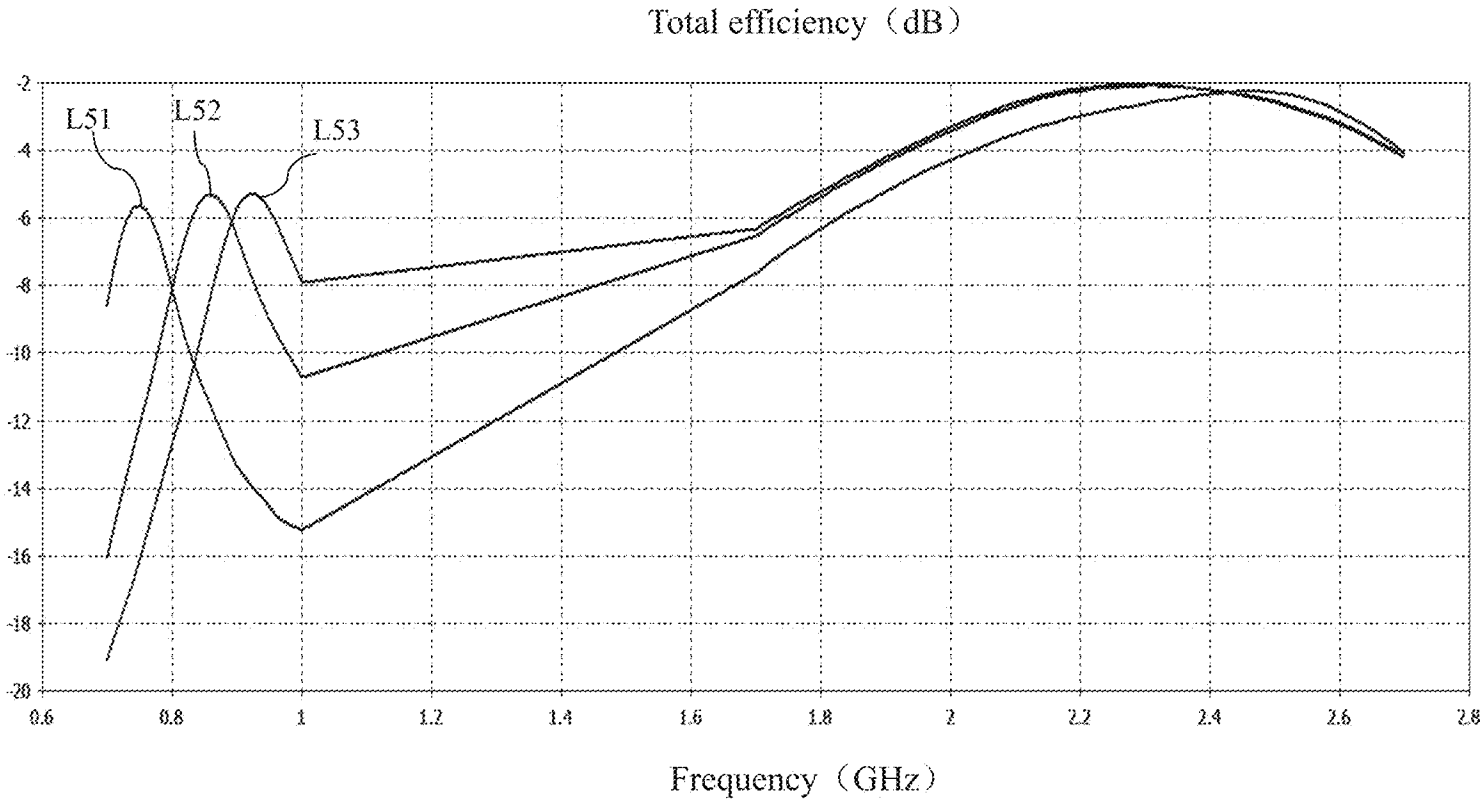
FIG. 5 is a view showing total efficiency of a first main antenna in FIG. 2.

FIG. 4 and FIG. 5 show performance on return loss and total efficiency of the first main antenna. In FIG. 4 and FIG. 5, L41 and L51 respectively represents the return loss and total efficiency of the first main antenna when the first switch 51 is in a disconnected state. L42 and L52 respectively represents the return loss and total efficiency when the first switch is switched to a same branch. L43 and L53 respectively represents the return loss and total efficiency when the first switch is switched to another branch. The branch inductance which L42 is connected with is larger than the branch inductance which L43 is connected with.

Figure 6:
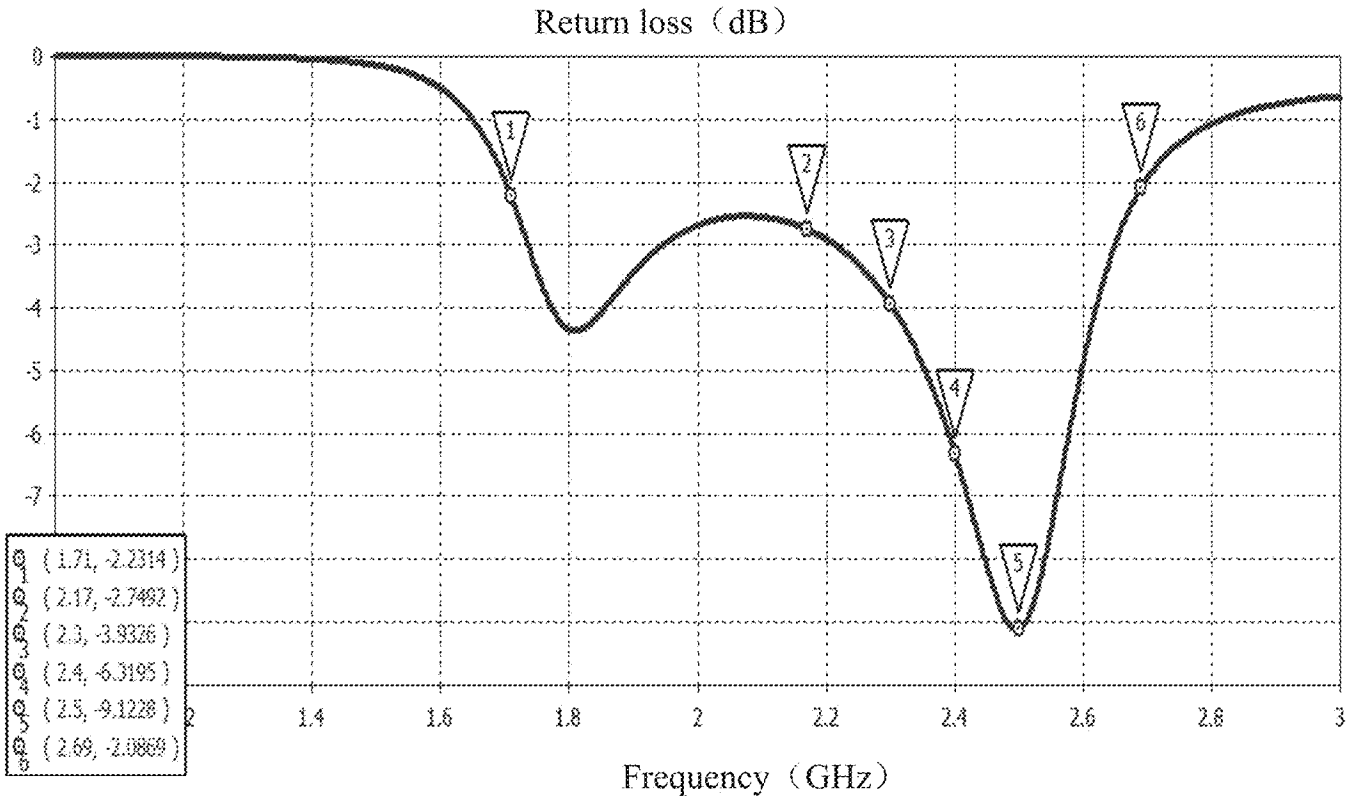
FIG. 6 is a view showing return loss of a second main antenna in FIG. 2.
Figure 7:
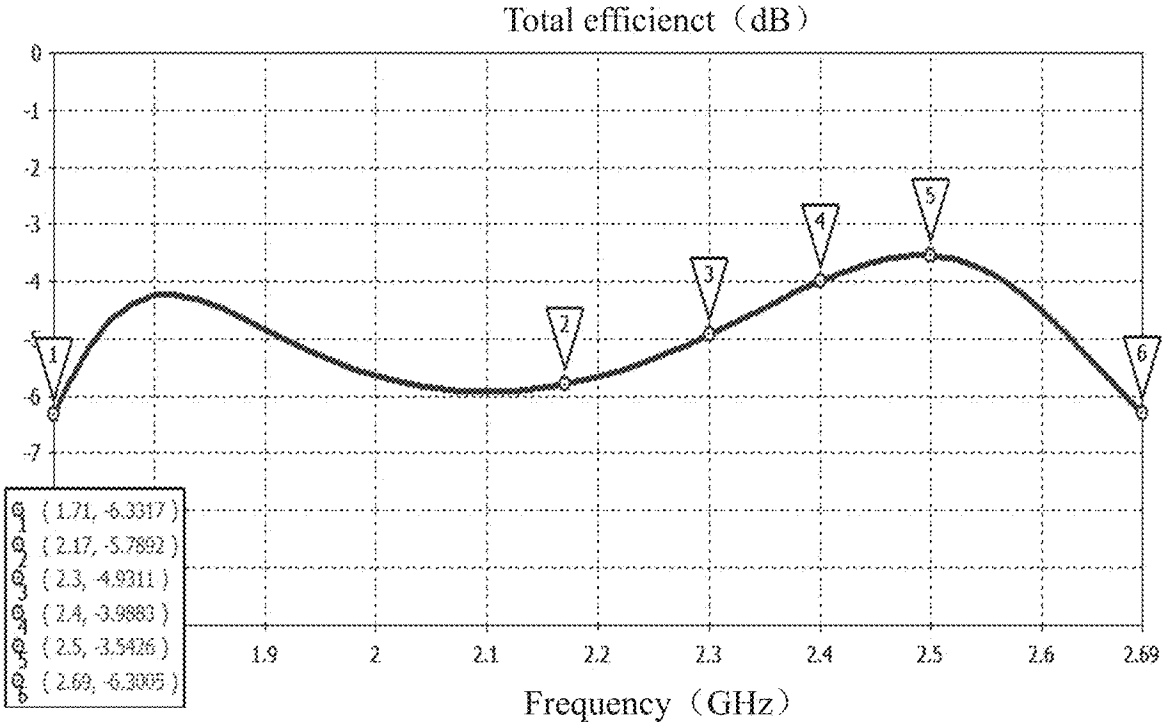
FIG. 7 is a view showing total efficiency of a second main antenna in FIG. 2.

FIG. 6 and FIG. 7 show performance on return loss and total efficiency of the second main antenna when the first main antenna is in a feeding state.

Figure 8:
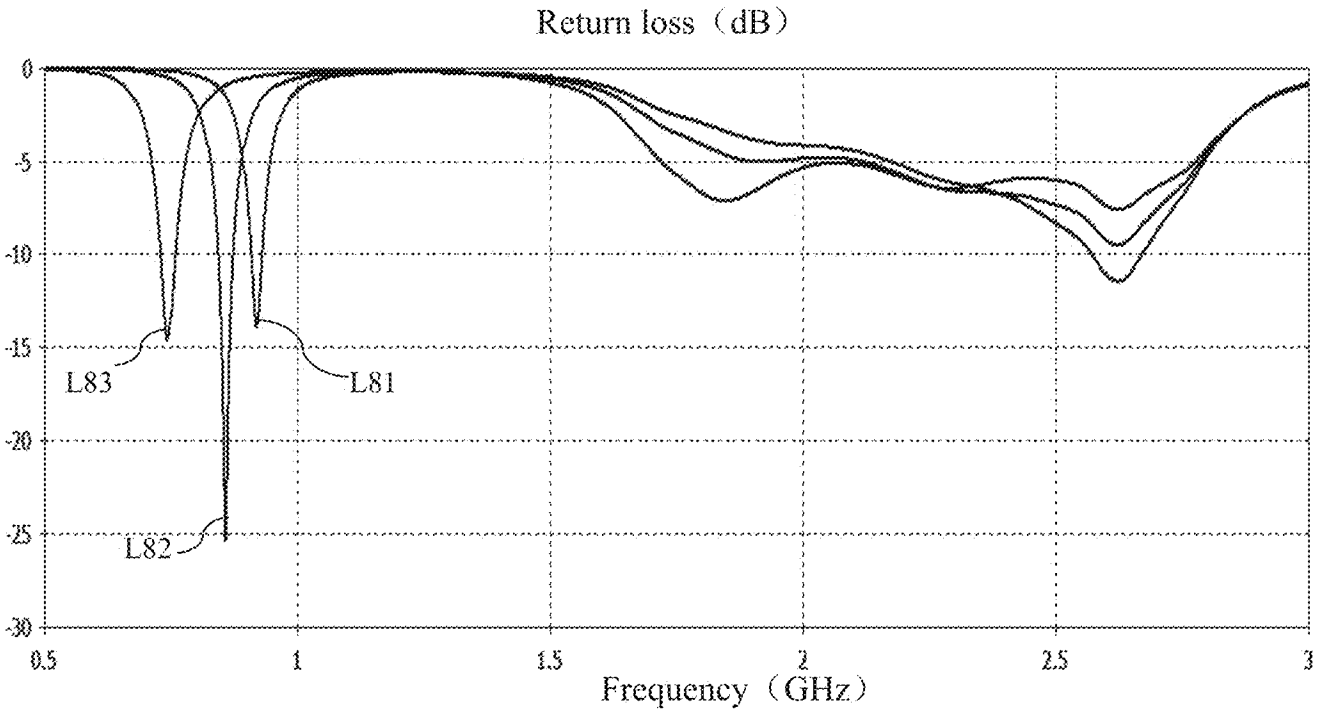
FIG. 8 is a view showing return loss of a first auxiliary antenna in FIG. 3.
Figure 9:
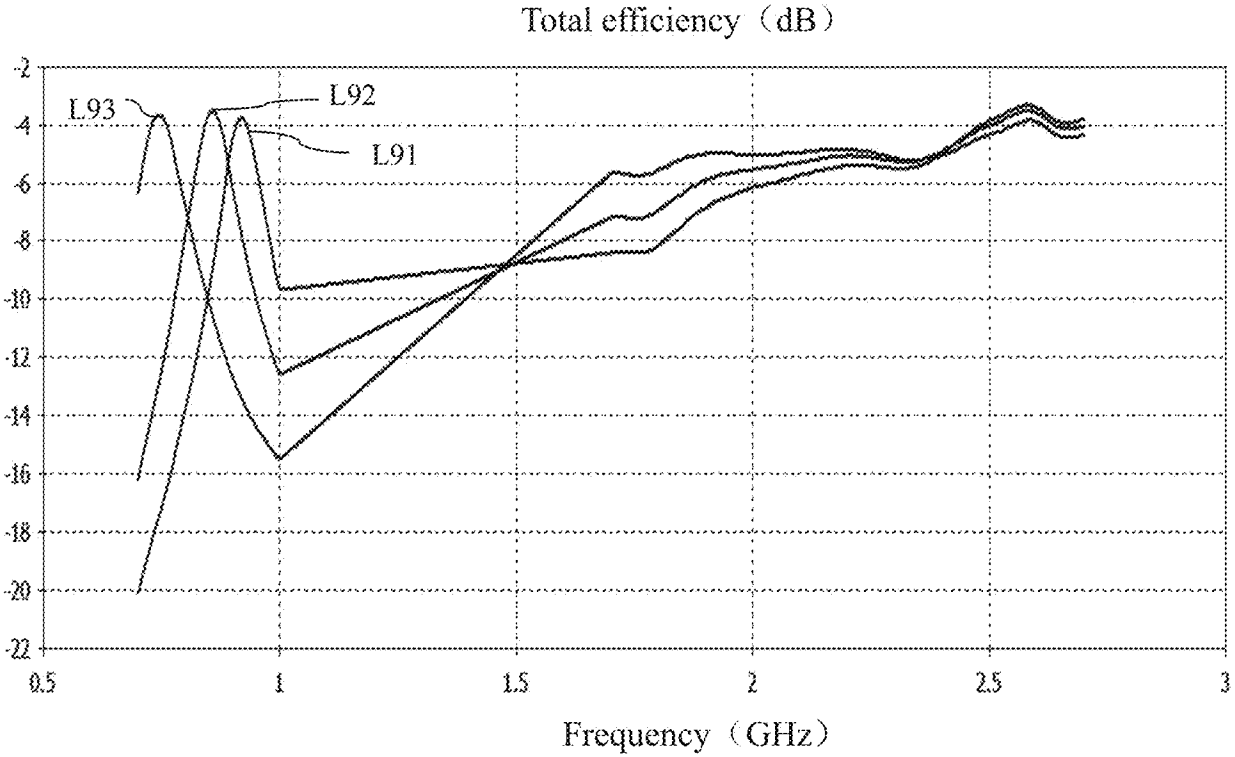
FIG. 9 is a view showing total efficiency of a first auxiliary antenna in FIG. 3.

FIG. 8 and FIG. 9 show performance on return loss and total efficiency of the first auxiliary antenna. In FIG. 8 and FIG. 9, L81, L82 and L83 respectively represents the return loss curve when the first switch 51 is switched to different branches. L91, L92 and L93 respectively represents the total efficiency of the first auxiliary antenna when the first switch is switched to the branches corresponding to L81, L82 and L83. The inductance in branches which L81, L82 and L83 are connected with reduces successively.

Figure 10:
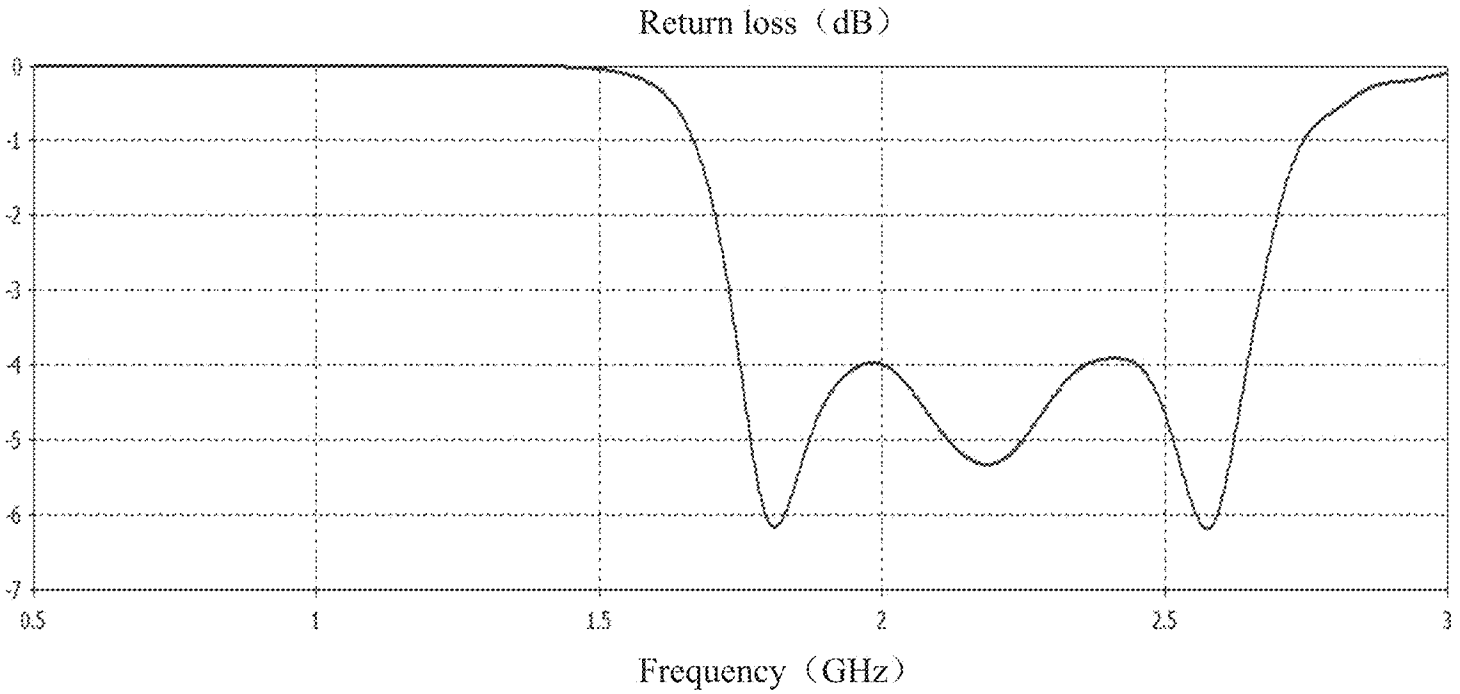
FIG. 10 is a view showing return loss of a second auxiliary antenna in FIG. 3.
Figure 11:
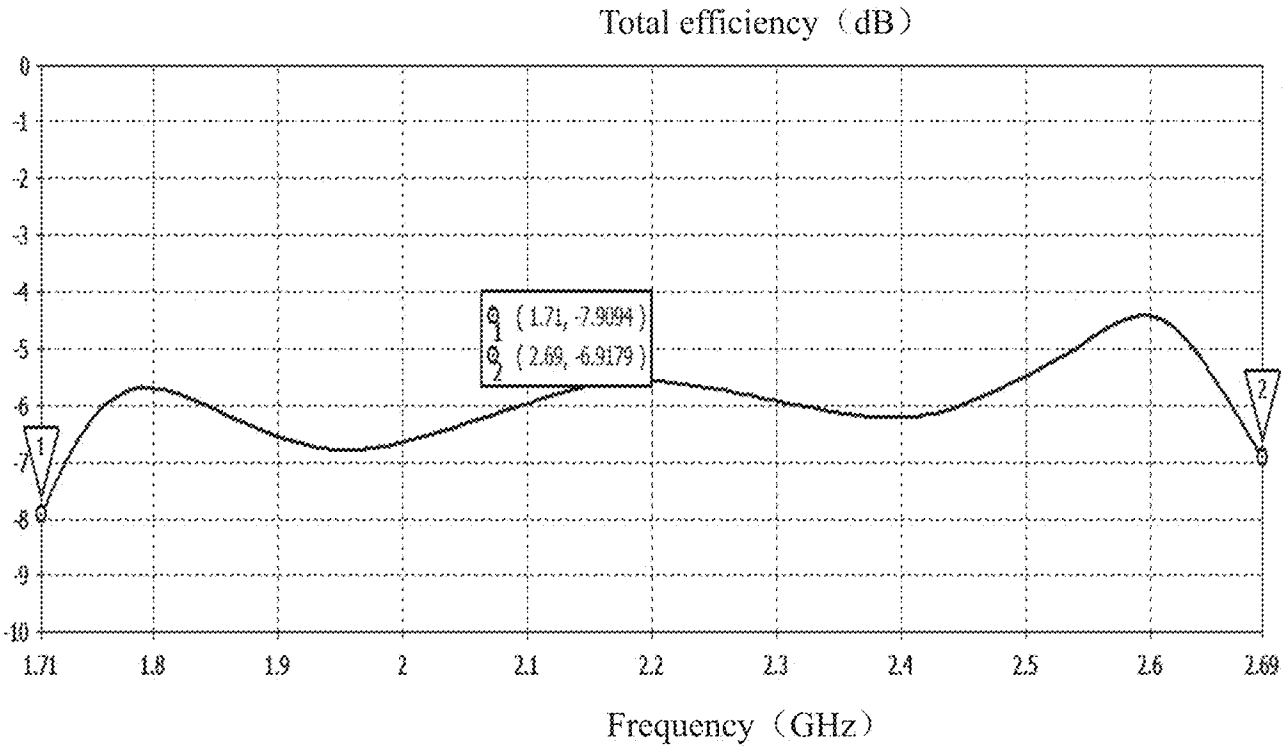
FIG. 11 is a view showing total efficiency of a second auxiliary antenna in FIG. 3.

FIG. 10 and FIG. 11 show performance on return loss and total efficiency of the second auxiliary antenna when the first auxiliary antenna is in a feeding state.

Please refer to FIGS. 4-11, the first main antenna 201 and the first auxiliary antenna 203 are both full-band antennas, while the second main antenna 202 and the second auxiliary antenna 204 are both middle-high frequency band antennas, which can achieve FDD and TDD functions.

Specifically, in the antenna system 100 of the present disclosure, the first main antenna 201 formed by the first main radiator 211 has working frequency bands of 703-960 MHz, 1710-2170 MHz, 2300-2400 MHz and 2500-2690 MHz. A portion of the first main radiator 211 located between the first grounding circuit 31 and the first fracture 213 forms a capacitance feeding branch of the capacitance connected in series of the first main antenna 201, and generates low frequency high order harmonic. A portion of the first main radiator 211 provided between the first fracture 213 and the second grounding circuit 32 forms a parasitic branch of the first main antenna 201.

The second main antenna 202 formed by the second main radiator 212 has working frequency bands of 1710-2170 MHz, 2300-2400 MHz and 2500-2690 MHz. The gap between the third grounding circuit 33 and the fourth grounding circuit 34 is the second main gap 7, which forms the gap antenna branch of the second main antenna 202. A portion of the second main radiator 212 located between the second feeding circuit 42 and the fourth grounding circuit 34 forms a loop antenna branch of the second main antenna 202.

The first auxiliary antenna 203 formed by the first auxiliary radiator 221 has working frequency bands of 703-960 MHz, 1710-2170 MHz, 2300-2400 MHz and 2500-2690 MHz. A portion of the first auxiliary radiator 221 located between the fifth grounding circuit 35 and the second fracture 223 forms a capacitance feeding branch of the capacitance connected in series, and generates low frequency high order harmonic. A portion of the first auxiliary radiator 221 provided between the second fracture 223 and the sixth grounding circuit 36 forms a parasitic branch of the first auxiliary antenna 203.

The second auxiliary antenna 204 formed by the second auxiliary radiator 222 has working frequency bands of 1710-2170 MHz, 2300-2400 MHz and 2500-2690 MHz. The gap between the seventh grounding circuit 37 and the eighth grounding circuit 38 is the second auxiliary gap 9, which forms the gap antenna branch of the second auxiliary antenna 204.

The above configuration makes the antenna system 100 cover full frequency bands, and the four-antenna structure cooperates with each other, so as to achieve higher transceiving efficiency.

Optionally, the antenna system 100 can make full use of the structure of the antenna radiator 2, the antenna radiator 2 is configured with other antennas, such as a WIFI antenna 205 between the first main radiator 211 and the first auxiliary radiator 221, and a GPS/WIFI antenna 206 between the second main radiator 212 and the second auxiliary radiator 222. Obviously, the above is possible, which can be arranged according to actual needs. Comparing with the prior art, the antenna system of the present disclosure makes full use of the fracture, parasitism, loop, and headroom structure etc., through a combination of a plurality of manners to achieve the above four communication antennas structure, so that the antenna system covers full frequency bands, and has high transceiving efficiency. When realizing the multiple communication antenna structure, the fracture, parasitism, loop and headroom structures are sufficiently combined, so as to reduce number of fractures and width of the headroom, thereby improving overall appearance of the antenna system.

Taking that the antenna system 100 is applied in a cellphone with metal frame as an example: when the antenna system 100 is assembled in the cellphone, metal frame of the cellphone serves as the antenna radiator 2, the PCB of the cellphone serves as the system ground unit.

The main radiator 21 and the auxiliary radiator 22 of the antenna radiator 2 are respectively the metal frame at the bottom and at the top of the cellphone, the grounding circuit 3 and the feeding circuit 4 are connected with the metal frame and PCB board of the cellphone, so as to achieve signal radiation. Therefore, through the metal frame structure of the cellphone, a full-band coverage of the antenna system 100 can be achieved, and only two openings are required on the metal frame, which will not affect the overall appearance of the cellphone.

Obviously, the antenna system 100 of the present disclosure is not limited to be applied in the cellphone, which can also be applied in electronic communication products such as laptop etc., the principles are similar.

The above are only embodiments of the present disclosure, which are not intended to limit the protection scope of the present disclosure, any equivalent structure or process made on the basis of the description and figures the present disclosure, or a direct or indirect application in other relevant technical fields shall fall into the protection scope of the present disclosure.

What is claimed is:

1. An antenna system, comprising:

a system ground unit;

a metal back cover electrically connected with the system ground unit;

a frame which is provided surrounding a periphery of the metal back cover and serves as an antenna radiator; and a grounding circuit, a feeding circuit and a tuning switch respectively connected with the antenna radiator and the system ground unit, wherein the antenna radiator comprises a main radiator and an auxiliary radiator provided at two opposite sides of the metal back cover;

the main radiator comprises a first main radiator which forms, together with the metal back cover, a first main gap and a first main antenna, a second main radiator which extends from the first main radiator and forms, together with the metal back cover, a second main gap and a second main antenna, and a first fracture which separates the first main radiator into two parts;

the auxiliary radiator comprises a first auxiliary radiator which forms, together with the metal back cover, a first auxiliary gap and a first auxiliary antenna, a second auxiliary radiator which extends from the first auxiliary radiator and forms, together with the metal back cover, a second auxiliary gap and a second auxiliary antenna, and a second fracture which separates the first auxiliary radiator into two parts.

2. The antenna system as described in claim 1, wherein widths of the first main gap, the second main gap, the first auxiliary gap, and the second auxiliary gap are within 1.5 mm-2 mm.

3. The antenna system as described in claim 1, wherein the grounding circuit comprises a first grounding circuit and a second grounding circuit respectively provided at two ends of the first main radiator and electrically connected with the system ground unit; the first fracture is provided between the first grounding circuit and the second grounding circuit;

the feeding circuit comprises a first feeding circuit provided between the first fracture and the first grounding circuit; the tuning switch comprises a first switch provided between the first fracture and the first feeding circuit;

a portion of the first main radiator located between the first grounding circuit and the first fracture forms a capacitance feeding branch of the first main antenna; a portion of the first main radiator located between the first fracture and the second grounding circuit forms a parasitic branch of the first main antenna.

4. The antenna system as described in claim 3, wherein the grounding circuit further comprises a third grounding circuit and a fourth grounding circuit respectively provided at two ends of the second main radiator and electrically connected with the system ground unit; the third grounding circuit is adjoined with the second grounding circuit, and a gap provided between the third grounding circuit and the fourth grounding circuit is the second main gap;

the feeding circuit further comprises a second feeding circuit provided between the third grounding circuit and the fourth grounding circuit;

the second main gap forms a gap antenna branch of the second main antenna, and a portion of the second main radiator located between the second feeding circuit and the fourth grounding circuit forms a loop antenna branch of the second main antenna.

5. The antenna system as described in claim 4, wherein the grounding circuit further comprises a fifth grounding circuit and a sixth grounding circuit respectively provided at two ends of the first auxiliary radiator and electrically connected with the system ground unit; the second fracture is provided between the fifth grounding circuit and the sixth grounding circuit;

the feeding circuit comprises a third feeding circuit provided between the second fracture and the fifth grounding circuit; the tuning switch comprises a second switch provided between the third feeding circuit and the fifth grounding circuit;

a portion of the first auxiliary radiator located between the fifth grounding circuit and the second fracture forms a capacitance feeding branch of the first auxiliary antenna; a portion of the first auxiliary radiator provided between the second fracture and the sixth grounding circuit forms a parasitic branch of the first auxiliary antenna.

6. The antenna system as described in claim 5, wherein the grounding circuit further comprises a seventh grounding circuit and an eighth grounding circuit respectively provided at two ends of the second auxiliary radiator and electrically connected with the system ground unit; the seventh grounding circuit is adjoined with the sixth grounding circuit, and a gap provided between the seventh grounding circuit and the eighth grounding circuit is the fourth auxiliary gap;

the feeding circuit comprises a fourth feeding circuit provided between the seventh grounding circuit and the eighth grounding circuit; the tuning switch comprises a third switch provided between the seventh grounding circuit and the fourth feeding circuit;

the fourth auxiliary gap forms a gap antenna branch of the second auxiliary antenna.

7. The antenna system as described in claim 1, wherein the metal back cover is spaced from the frame for a certain distance respectively through the first main gap, the second main gap, the first auxiliary gap and the second auxiliary gap, so as to form a first headroom region, a second headroom region, a third headroom region and a fourth headroom region;

widths of the first headroom region, the second headroom region, the third headroom region and the fourth headroom region are within 1.5 mm-2 mm.

8. The antenna system as described in claim 1, wherein widths of the first fracture and the second fracture are within 1 mm-1.5 mm.

9. The antenna system as described in claim 8, wherein the first fracture and the second fracture are filled with non-metal material.

10. The antenna system according to claim 1, further comprising a WIFI antenna provided on the antenna radiator and between the first main radiator and the first auxiliary radiator, and a GPS/WIFI antenna provided on the antenna radiator and between the second main radiator and the second auxiliary radiator.

* * * * *